US005742310A

United States Patent [19]

Kotaki

[11] Patent Number: 5,742,310

[45] Date of Patent: Apr. 21, 1998

[54] INK JET PRINTER AND AN INK STORING MEMBER MOUNTED ON THE PRINTER

[75] Inventor: Yasuo Kotaki, Machida, Japan

[73] Assignee: Canon Kabushiki Kaisha, Tokyo, Japan

[21] Appl. No.: 606,756

[22] Filed: Feb. 27, 1996

[30] Foreign Application Priority Data

Feb. 28, 1995 [JP] Japan ..... 7-040815

[51] Int. Cl.[6] ..... B41J 2/175

[52] U.S. Cl. ..... 347/86

[58] Field of Search ..... 347/84, 85, 86, 347/87

[56] References Cited

U.S. PATENT DOCUMENTS

| | | | |
|---|---|---|---|
| 5,425,478 | 6/1995 | Kotaki et al. | 222/501 |
| 5,598,198 | 1/1997 | Taylor et al. | 347/85 |
| 5,619,239 | 4/1997 | Kotaki et al. | 347/86 |
| 5,629,727 | 5/1997 | Erickson | 347/85 |

FOREIGN PATENT DOCUMENTS

| | | | |
|---|---|---|---|
| 0469536 | 2/1992 | European Pat. Off. | B41J 2/175 |
| 0501789 | 2/1992 | European Pat. Off. . | |
| 0526062 | 3/1993 | European Pat. Off. | B41J 25/34 |
| 0546832 | 6/1993 | European Pat. Off. | B41J 2/175 |
| 0607859 | 7/1994 | European Pat. Off. | B41J 25/34 |
| 0623471 | 11/1994 | European Pat. Off. | B41J 2/175 |
| 0639462 | 2/1995 | European Pat. Off. | B41J 2/175 |
| 4282253 | 10/1992 | Japan . | |

*Primary Examiner*—Stuart N. Hecker

*Attorney, Agent, or Firm*—Fitzpatrick, Cella, Harper & Scinto

[57] ABSTRACT

An ink jet printer for recording on a recording medium by discharging the ink supplied from an ink storing member from an ink jet head to the recording medium is disclosed. The ink jet printer comprises a mount portion for mounting detachably the ink storing member, a space for receiving said mount portion, and a recording selection unit for selecting a first recording mode in which a first ink storing member received within the space is mounted on the mount portion in recording, or a second recording mode in which a second ink storing member large enough not to be received within the space is mounted on the mount portion in recording.

20 Claims, 9 Drawing Sheets

INK JET PRINTER AND AN INK STORING MEMBER MOUNTED ON THE PRINTER

DESCRIPTION OF THE INVENTION

1. Field of the Invention

The present invention relates to an ink jet printer for recording on the recording medium by discharging the ink, and more particularly to an ink jet printer having a carriage capable of holding freely detachably an ink tank of different capacity and an ink storing member mounted on the printer.

2. Related Background Art

Conventionally, the recording apparatuses for recording on the recording medium (hereinafter simply referred to as a recording sheet) such as a paper, a cloth, a plastic sheet, or an OHP sheet, have been proposed which mount a recording head based on any of various recording systems, such as, for example, a wire dot system, a thermal system, a thermal transfer system, and an ink jet system.

Among them, a recording apparatus using the ink jet system (an ink jet recording apparatus) is utilized for a printer as an output terminal from output means in the information processing system, such as for example, a copying machine, a facsimile apparatus, an electronic typewriter, a word processor or a workstation, or a printer equipped in a personal computer, a host computer, an optical disk unit, or a video device, and is commercially available.

A recording head for the ink jet recording apparatus makes use of an electromechanical converter such as a piezoelectric element or an electrothermal conversion element having a heat generating resistor as an energy generating element for generating the energy to discharge the ink from the discharge ports by heating the liquid.

Also, there is a market trend in recent years in which with the smaller personal computer, the printer that is an output device is also desirably constructed in smaller size and portably.

Further, the printer is rapidly changing from the monochrome machine to the color output machine. Along with this, the small handy printer is also desired to have a color output function.

However, various output data are provided by the user, and when outputting a graph or design, a high resolution color output function is required, while for outputting the monochrome data such as a text or document, the higher speed throughput is increasingly desired.

In this way, there is a need for meeting the requirements for the high resolution color image and the high speed monochrome output in accordance with the purposes of the user at the same time.

Owing to the smaller handy printer, the user can bring the printer outside (outdoors) to print at the destination. Also, the user may output on the table indoors, e.g., inside an office, as conventionally. The features required in such various situations include being compact to provide portability for outputting at the destination outdoors, and the lower cost, e.g., the lower running cost of ink tank, for outputting on the table in the office.

One of the methods for fulfilling such market demands is disclosed in Japanese Laid-Open Patent Application No. 4-282253, concerning means for providing a smaller printer.

In that patent, there was described for the miniaturization of printer an ink jet head cartridge having a recording head and an ink storing unit (hereinafter referred to as an ink tank) integrated, wherein an amount of stored ink corresponds to the life of the recording head. Specifically, an ink storing unit having a volume of storing the recording ink corresponding to the life of recording head is provided, and when recording, an ink jet head cartridge is protruded by opening a cover of printer to scan a carriage, whereas when not in recording (for storing), (a) the ink jet head cartridge is removed from the carriage, or (b) the ink jet head cartridge is accommodated within the printer by rotating it about 70° to 80° into a storage space for ink jet head cartridge provided within a main device at a home position of carriage.

However, this printer is one in which the smaller and thinner construction of the printer itself can be effected by mounting only an ink jet head cartridge of fixed size (extending from the printer cover) on the carriage, without miniaturizing the ink storing unit (ink jet head cartridge). Further, for the printer comprising a mechanism for receiving an ink jet head cartridge into the storage space for ink jet head cartridge provided within the main device by rotating the ink jet head cartridge, when storing it, there was a problem that the number of components increased and the structure became complex, thereby resulting in a larger construction of the printer itself.

Also, the portable type ink jet printer had the following problems.

That is, where an ink jet cartridge small enough to be contained in a space within a housing of the portable ink jet printer was mounted onto the carriage and a carriage protection cover was closed, it was apprehended that there might arise fine ink (hereinafter referred to as ink mist) in discharging the ink during the recording, other than the ink used for the formation of image to be recorded, which may scatter into this narrow closed space, and adhere to the recording medium such as a paper, a cloth, a plastic sheet, or an OHP sheet, thereby resulting in degraded recording quality.

This phenomenon was allowable to some extent for the monochrome printer which used only the black ink, but had a problem for the color printer which was more popular in the market nowadays, because should magenta (M) or cyan (C) stick to, in the yellow (Y) background, other than the area to be stuck as the recording image on the recording medium, the image itself might directly degrade.

This problem of ink mist should be considered more effortfully because there was a risk that the ink mist flying over the paper attached to the recording medium in larger quantity, due to a waiting time between paper feeds which increased to suppress the blur on the color image caused by color mixture in discharging the ink, while scanning the carriage over the same recording area at least twice, particularly in a fine mode for the output of high resolution color image.

Also, there was a problem that due to wind pressure occurring in scanning the carriage, the impinging position of ink mist on the recording medium was located away from those of ink droplets used for the image recording, with higher probability, resulting in the degraded recording image.

SUMMARY OF THE INVENTION

An object of the present invention is to provide an ink jet printer and an ink storing member mounted on the printer which is excellent in the portability and capable of effecting the high resolution image recording.

Also, it is another object of the invention to provide an ink jet printer and an ink storing member mounted on the printer which the user can select simply in accordance with the use purpose of the user, and the service conditions (e.g., color output (for high resolution), monochrome output (for higher speed), output at the destination (with enhanced portability), output on the desk (for lower running cost)).

Furthermore, it is another object of the invention to provide an ink jet printer for recording on a recording medium by discharging the ink supplied from an ink storing member from an ink jet head to the recording medium, comprising, a mount portion for mounting detachably the ink storing member, a space for receiving the mount portion, and a recording selection unit for selecting a first recording mode in which a first ink storing member received within the space is mounted on the portion in recording, or a second recording mode in which a second ink storing member large enough not to be received within the space is mounted on the mount portion in recording.

DETAILED DESCRIPTION OF THE PREFERRED EMBODIMENTS

The preferred embodiments of the present invention will be described below with reference to the drawings.

An ink jet recording apparatus will be first schematically described in detail.

Figure 1:
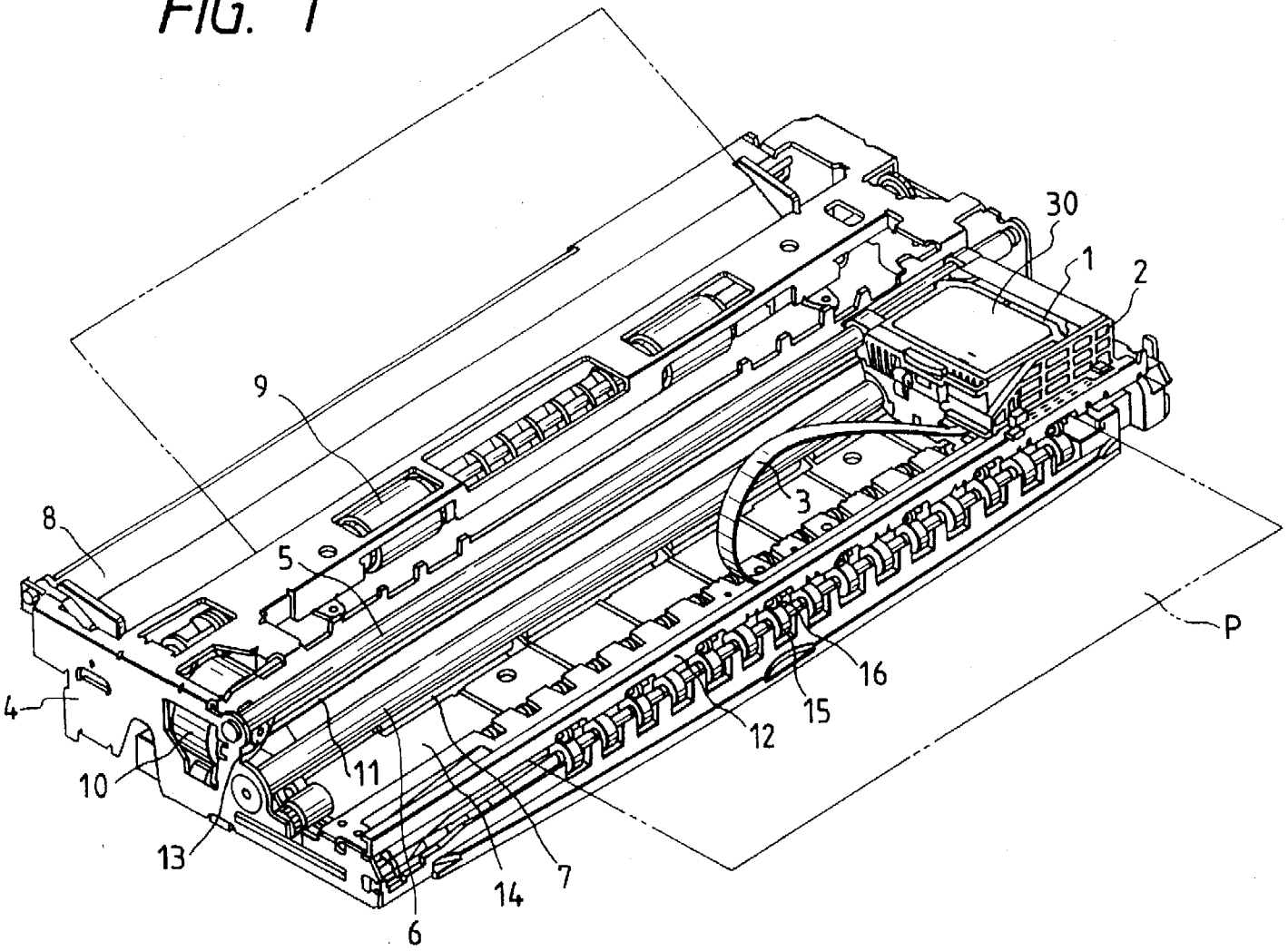
FIG. 1 is a constitutional view showing schematically an ink jet recording apparatus.

FIG. 1 is a constitutional view showing schematically the ink jet recording apparatus.

In FIG. 1, a carriage 2 is a cartridge carrying portion (cartridge carrying member) movable in a direction different than the conveying direction of the recording medium P, with a recording head cartridge (ink jet head cartridge) 1 freely detachably mounted thereon, this carriage being supported freely slidably on a guide shaft 5 and a guide rail 12 with their both ends secured to a frame 4 and disposed parallel to each other in a direction orthogonal to the conveying direction of the recording medium P, and parallel to the plane of recording medium P. Also, the carriage 2 is coupled to a part of a carriage drive belt 11 looped around a drive pulley 13 secured to an output shaft of a carriage drive motor 10 and a driven pulley (not shown) axially supported rotatably, whereby the carriage drive belt 11 is rotated by driving the carriage drive motor 10 to reciprocate the carriage in the above directions.

The recording head cartridge 1 comprises a head terminal portion 51 for receiving a recording signal which is an electrical signal for the ink discharge, a nozzle portion 50 (see FIGS. 5 and 6) as the recording head for discharging the ink from the ink discharge ports, a base plate 52 for supporting electrothermal converters such as heaters or electromechanical converters such as piezoelectric elements for generating the energy to discharge the ink from the ink discharge ports, and an ink tank holder (FIG. 3) for mounting a monochrome ink tank (a black ink tank 30 in this embodiment) solely or an ink tank holder 60 (FIG. 5) for mounting the monochrome ink tank (black ink tank 30*b*) and a color ink tank 30*a*. Each of the ink tank holders removably holds each of the black ink tank 30, the black ink tank 30*b* and the color ink tank 30*a*. The nozzle portion 50 is provided on a bottom portion (a lower end portion as shown in the figure) of the recording head cartridge 1 to discharge the ink downwards in the figure. A recording signal to the nozzle portion 50 is transmitted via a flexible cable 3 provided on the carriage 2 from a control substrate (not shown) for controlling the operation of this ink jet recording apparatus to the head terminal portion 51. The flexible cable 3 is disposed along a movement direction of the carriage 2, whereby a loop is formed with the movement of the carriage 2. The recording head cartridge 1 and the carriage 2 will be described later in detail.

On the other hand, the recording media P are laid on a pressure plate 8 with its both ends supported rotatably by the frame 4. The pressure plate 8 is biased toward a pick-up roller 9 by biasing means (not shown) to cause the recording media P laid on the pressure plate 8 to be pressed onto the pick-up roller 9. If the pick-up roller 9 is rotated upon a paper feed instruction, a recording medium P is delivered by a frictional force between the pick-up roller 9 and the recording medium P, but the pressure plate 8 has separation means (not shown) such as a separation claw which is used in a conventional automatic paper feeder, to allow only one recording medium P at the top position to be delivered under the action of this separation means.

The recording medium P delivered by the pick-up roller 9 is conveyed under the carriage 2, while being carried between a conveying roller 6 with its both ends supported by the frame 4 and a pinch roller 7 provided on the base 14. The recording takes place on the recording medium P at this position. Further, a paper exhausting roller (exhaust roller) 15 and a spur 16 are disposed, opposed to each other, downstream of the carriage 2 in the conveying direction of the recording medium P, the recording medium P having passed beneath the carriage 2 being carried between the paper exhausting roller 15 and the spur 16 and exhausted. The driving of the pick-up roller 9, the conveying roller 6 and the paper exhausting roller 15 as above cited is effected by a paper feed motor (not shown) as a driving source.

Next, a portable ink jet printer having the above ink jet recording apparatus accommodated within a housing according to one example of the present invention, and an ink tank for use therewith will be described below. In the following description, it should be noted that the upstream side in the conveying direction of the recording medium P is defined as a rear side, the downstream side as a fore side, and the lateral face on the fore side as a front face.

Figure 2:
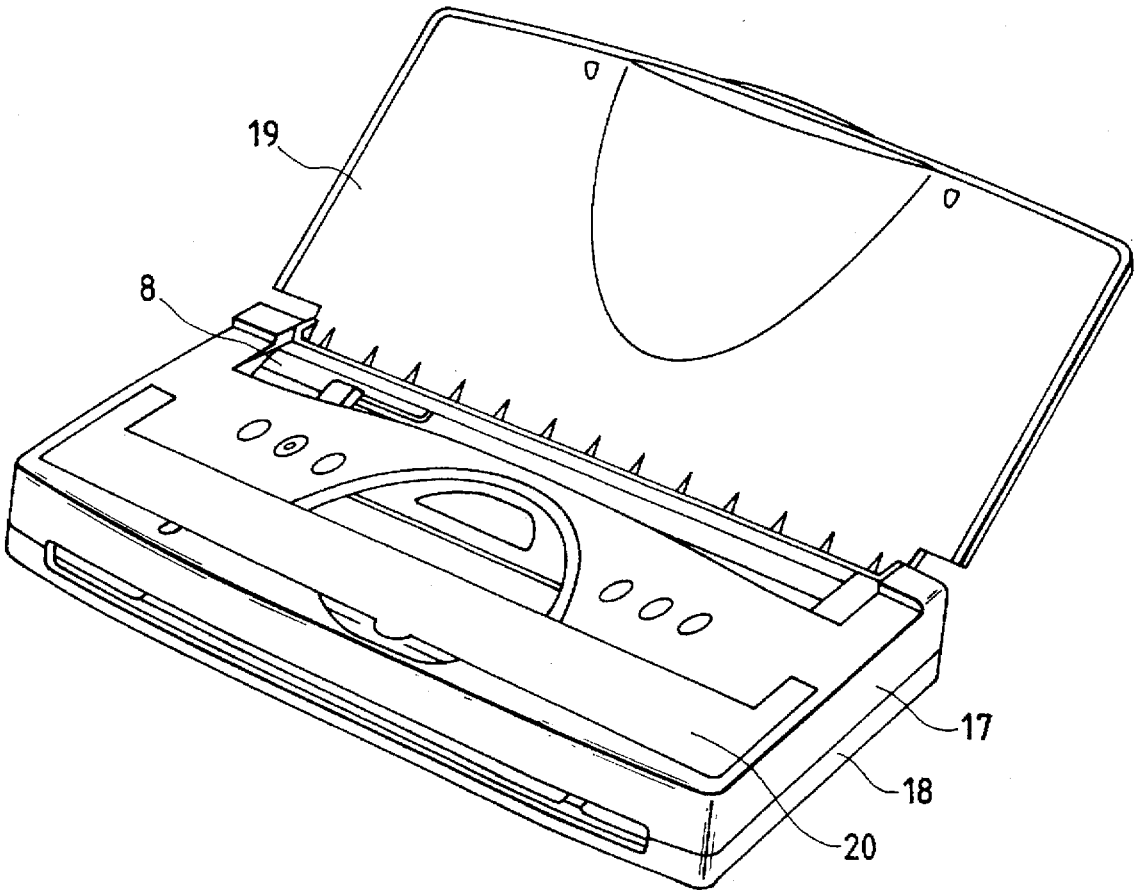
FIG. 2 is a perspective view showing the appearance of a portable ink jet printer according to one example of the present invention, with a top cover opened and with a carriage protection cover closed.
Figure 3:
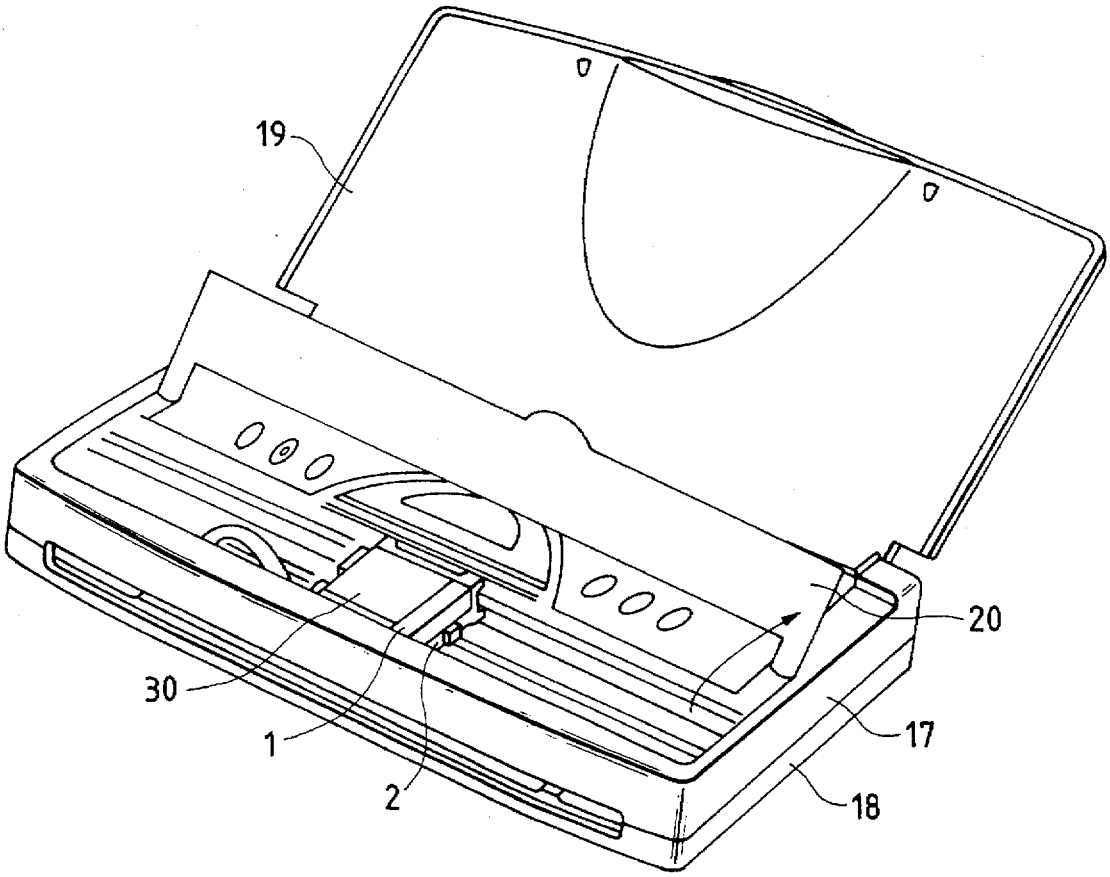
FIG. 3 is a view showing the portable ink jet printer as shown in FIG. 2, with the carriage protection cover opened.

FIGS. 2 and 3 are perspective views illustrating the appearance of the portable ink jet printer according to one example of the present invention, wherein a top cover is opened, and a carriage protection cover is closed and opened, respectively.

As shown in FIGS. 2 and 3, the portable ink jet printer of this example has an outer package constituted of a lower case 18 and an upper case 17, within which the ink jet recording apparatus as shown in FIG. 1 is accommodated.

The top cover 19 for covering the upper case 17 is provided freely openably or closably on the rear side of the upper case 17. The upper case 17 has an aperture portion at a region corresponding to the pressure plate 8, wherein the top cover 19 becomes a tray to set the recording medium P on the pressure plate 8 by opening the top cover 19. Further, the upper case 17 has an opening portion extending from its central portion to the front face, through which the recording head 1 or the ink tank 30 can be mounted or dismounted. Therefore, in exchanging the recording head cartridge 1 or the ink tank 30, the carriage 2 is moved to a central position of its movement area through a predetermined operation. The carriage protection cover 20 for covering a part of the upper surface of this opening portion and the front face is provided freely openably or closably on the fore side of this opening portion for the exchange of the recording head cartridge 1 or the ink tank 30. This carriage protection cover 20 is provided with a locking mechanism (not shown) for locking it in the open state. The carriage protection cover 20 must be opened to exchange the recording head cartridge 1 or the ink tank 30.

Figure 4:
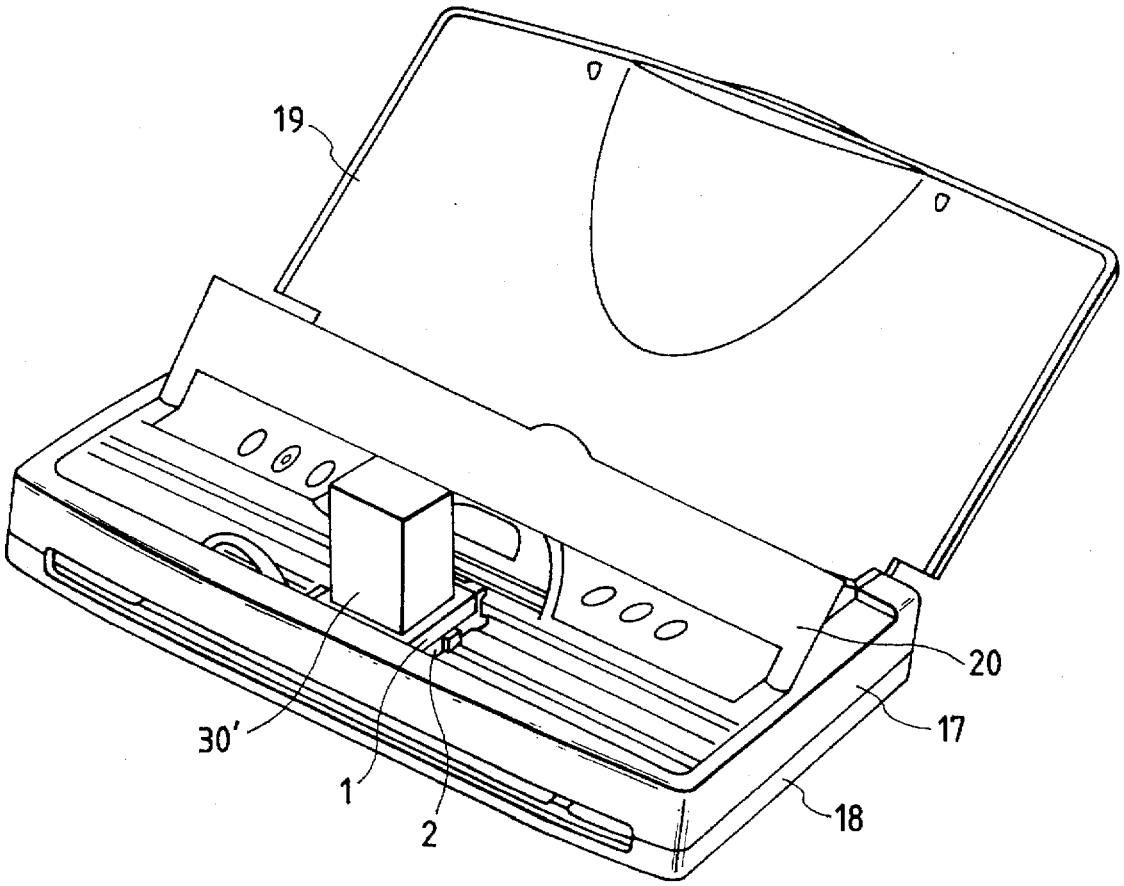
FIG. 4 is a perspective view showing the portable ink jet printer as shown in FIG. 2 having an ink tank of large capacity attached on the recording head cartridge, with the carriage protection cover locked in an open state.

The portable ink jet printer of this example can mount two types of ink tanks, an ink tank of small capacity (standard capacity) which is excellent in the portability (see FIG. 5), and an ink tank of large capacity which is favorable for the lower running cost (see FIG. 6) for the recording. When the ink tank of large capacity is mounted on the recording head cartridge 1, the carriage protection cover 20 is locked in the open state as shown in FIG. 4 to effect the recording. The capacity of the ink tank of large capacity is desirably one-and-half times or greater that of standard ink tank (ink tank of small capacity), in view of the running cost. Also, the size (or height) of this ink tank of large capacity can be set within an acceptable range of recording space (carriage movement space), but in consideration of the degree of freedom on the design, the carriage driving force, the protection by the carriage protection cover 20, and the appearance, the cross-sectional area of the scan space of the carriage with the ink tank mounted crosswise to a sliding direction of the carriage is desirably set to 50 mm or less laterally and 70 mm or less high.

It should be noted in this example that with the carriage is accommodated with the carriage protection cover 20 closed, the cross-sectional area of an inner space allowing for the scanning crosswise to the carriage sliding direction being within a range of 50 mm laterally and 30 mm high.

In this example, the bottom area of the ink jet head cartridge and the bottom area which the ink tank occupies are made substantially equal, an increased volume of the ink tank of large capacity in the ink storing unit extending directly upwards. When recording with the ink tank of large capacity, the carriage protection cover is opened to perform the recording, whereby any more excess area on the carriage for mounting the ink tank of large capacity is unnecessary when the ink tank of large capacity is used, as compared with when the ink tank of normal capacity is used, resulting in the smaller printer.

As will be described later, if the carriage protection cover is opened to perform the recording, the attachment of ink mist can be suppressed to the minimum, whereby the recording can be effected at high resolution.

Herein, the recording head cartridge (also referred to as an ink tank holder) and the ink tank will be described below.

In the portable ink jet printer of this example, the recording head cartridge and the ink tank can be selectively mounted or dismounted in accordance with the service conditions for the user and the output data.

Figure 5:
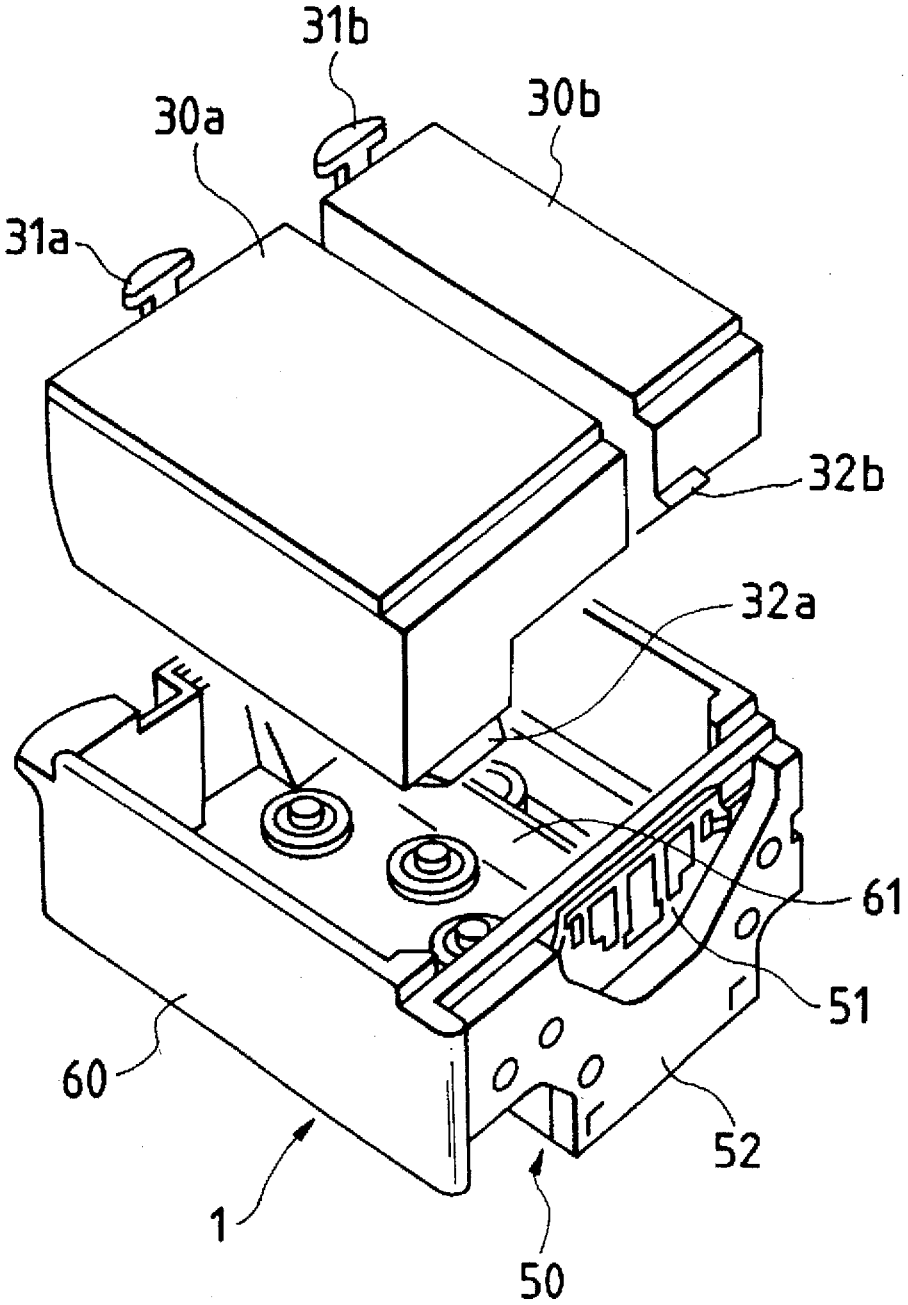
FIG. 5 is a view showing the recording head cartridge with a color ink tank and a black ink tank which are of small capacity attached thereto.

More specifically, the portable ink jet printer of this example can mount selectively a monochrome recording ink jet head cartridge 1 as shown in FIG. 3 or a color recording ink jet head cartridge 1 as shown in FIG. 5 on the carriage 2, and install a black ink tank (30 in FIG. 3) which is mountable on the monochrome ink jet head cartridge and a color ink tank which is mountable on the color recording ink jet head cartridge (a black ink tank **30*b* and a color ink tank 30*a* as shown in FIG. 5**) to perform the recording.

In a text or document where output data is only black, a monochrome ink jet head cartridge (1 in FIG. 3) is attached on the carriage by an elastic latch lever (not shown). And a black ink tank (30 in FIG. 3) is attached on this ink jet head cartridge by operating the latch lever (see FIG. 5), whereby the high speed data output is enabled and the running cost is reduced.

On the other hand, when the color image is output, a color ink jet head cartridge (1 in FIG. 5) and a color ink tank (**30*a*, 30*b* in FIG. 5) are selected and mounted on the carriage 2**. By such exchange, the high resolution color recording can be effected more simply.

In this way, by making the recording head cartridge (tank holder) and the ink tank simply exchangeable in accordance with the service conditions, a user-friendly printer can be provided.

While in this example, the ink jet head cartridge 1 accommodates the nozzle portion 50 and the ink tank which are separately provided, but it is not limited thereto, and may be an ink jet printer in which the ink jet head cartridge having the ink storing unit of normal capacity and the ink jet head integrated, or the ink jet head cartridge having the ink storing unit of large capacity and the ink jet head integrated is appropriately selected and mounted on the carriage 2.

Also, in this example, the ink jet printer equipped with the carriage was described, but it is not limited thereto, and may be a printer of the type using a so-called full-line ink jet head having an array of ink discharge ports of a length corresponding to a recordable width of the recording medium in a direction substantially orthogonal to the conveying direction of the recording medium, in which the head itself is not moved with respect to the recording medium to be conveyed during the recording operation, and a plurality of ink storing members of different capacities for storing the ink to supply the ink to the full-line ink jet head can be mounted on the ink storing member mount portion.

Next, the ink tank of small capacity and the ink tank of large capacity will be described below.

Figure 6:
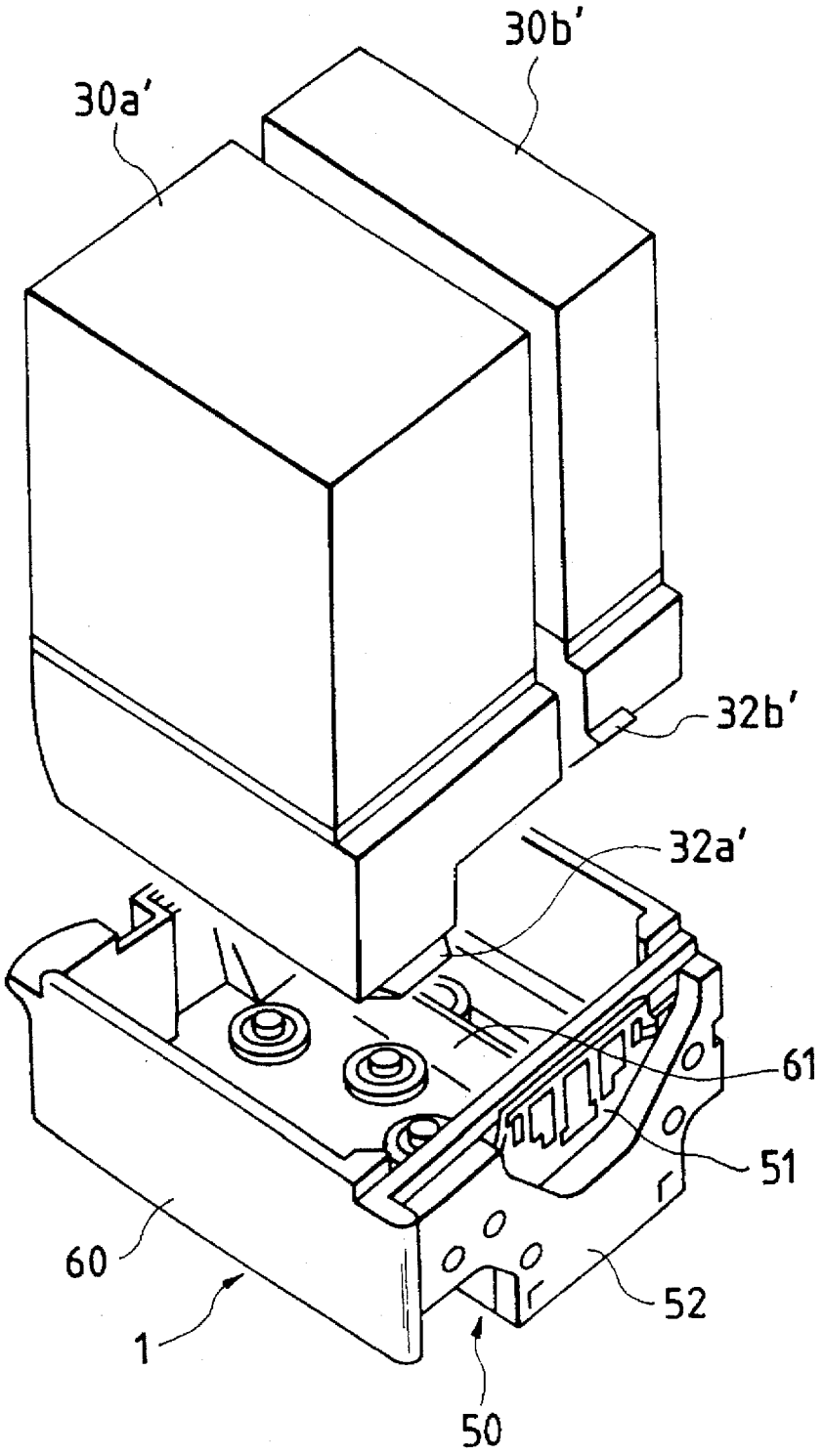
FIG. 6 is a view showing the recording head cartridge 1 with a color ink tank and a black ink tank which are of large capacity attached thereto.

FIG. 5 is a view in which the color ink tank **30*a* and the black ink tank 30*b* which are the ink tank of small capacity are mounted on the recording head cartridge 1. FIG. 6 is a view in which the color ink tank 30*a*' and the black ink tank 30*b*' which are the ink tank of large capacity are mounted on the recording head cartridge 1**.

In FIG. 5, the recording head cartridge 1 comprises an ink tank holder 60 which receives the color ink tank 30*a* and the black ink tank 30*b* via a partition plate 61, and has the nozzle portion 50 having an array of discharge ports for discharging the ink supplied from each ink tank received within the ink tank holder. The color ink tank 30*a* and the black ink tank 30*b* are provided with the latch levers 31*a*, 31*b* having the resiliency which are the locking mechanism in securing the ink tank to the ink tank holder 60, and the engaging pawls 32*a*, 32*b* for engaging the ink tank received within the ink tank holder 60 on the bottom side of the lateral face opposite this latch lever. The color ink tank 30*a*' and the black ink tank 30*b*' are of the same structure as the ink tanks 30*a*, 30*b*, except that the tank is extended in a height direction, and are also provided with the latch levers (not shown) and the engaging pawls 32*a*', 32*b*', respectively. The constitution of the color ink tank 30*a*, 30*a* ' will be described below.

Figure 7A:
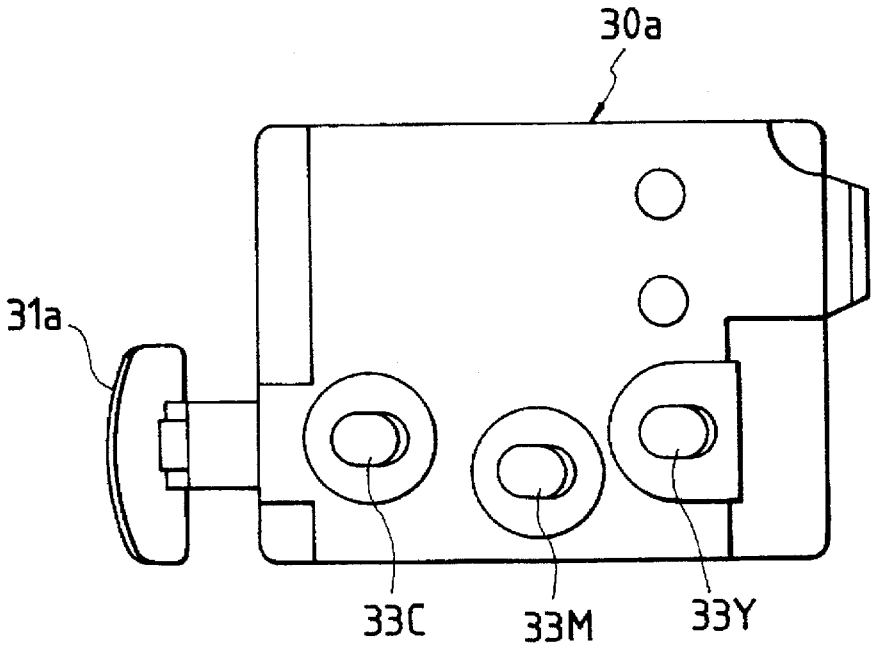
FIG. 7A is a bottom view of the color ink tank as shown in FIG. 5.
Figure 7B:
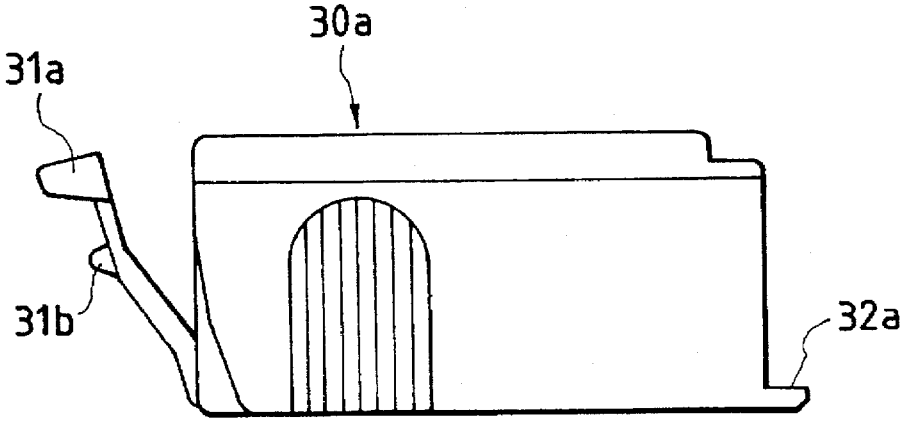
FIG. 7B is a side view thereof.
Figure 8A:
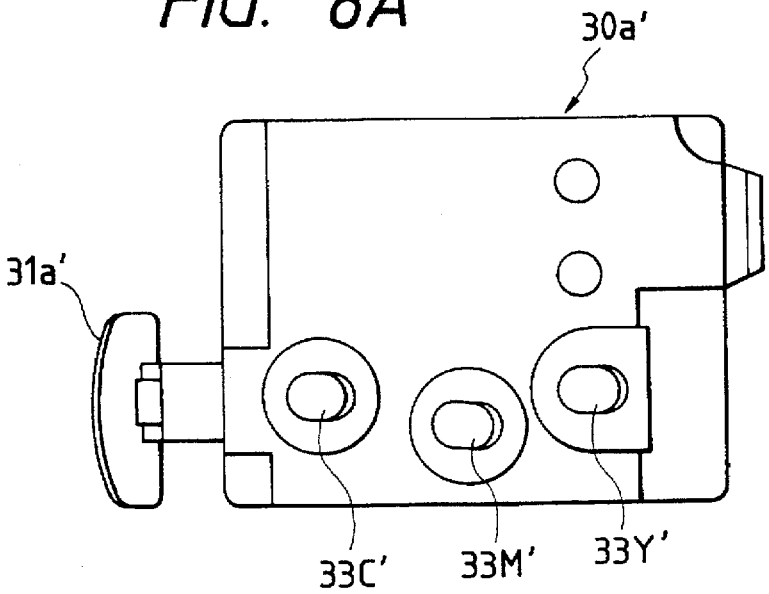
FIG. 8A is a bottom view of the color ink tank as shown in FIG. 6.
Figure 8B:
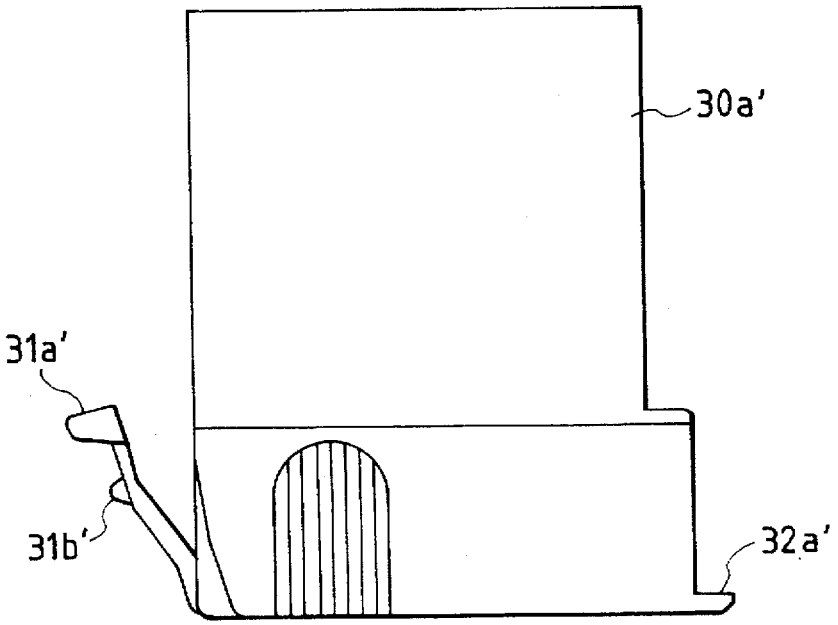
FIG. 8B is a side view thereof.

FIG. 7A is a bottom view of the color ink tank 30*a*, and FIG. 7B is a side view thereof. The color ink tank 30*a* is comprised of a vessel for reserving the ink, and a lid member for sealingly covering this vessel, with the ink supply ports 33C, 33M, 33Y corresponding to the inks of cyan, magenta and yellow formed on the bottom of the vessel. The latch lever 31*a* is provided with a latch pawl 31*b* for securing the ink tank to the ink tank holder 60. The color ink tank 30*a*' is of the same structure as above, except that the capacity of tank is different, wherein its bottom view is shown in FIG. 8A and its side view is shown in FIG. 8B. The black ink tanks 30*b*, 30*b*', not shown, are also of the same structure as the above color tanks, except that only one ink supply port is provided.

The ink tanks as above are manufactured through a process of filling the ink within the vessel for reserving the ink inside, and when an ink tank is received and secured within the ink tank holder by fitting a hooking pawl of the ink tank into a hooking pawl engagement hole (not shown), and a latch pawl for the ink tank into a latch pawl engagement hole (not shown) in the ink tank holder. Each ink tank can be mounted or dismounted by operating the latch lever.

The printer of this example as above described has a first recording mode in which the form of using an ink tank 30 of normal capacity (an ink tank of the size usable with the carriage protection cover 20 closed) within the ink tank holder 60 for the ink jet head cartridge 1 with the carriage protection cover 20 closed, or the form of using the ink tank with the carriage protection cover 20 opened for the countermeasure of ink mist can be selected, and a second recording mode in which an ink tank 30' of large capacity which has to be used with the carriage protection cover 20 opened is used to perform the image recording.

Further, the printer of this example comprises a first service form in which the black ink tank 30*b* of normal capacity and the color ink tank 30*a* of normal capacity as shown in FIG. 5 are mounted within the ink tank holder 60, and a second service form in which the black ink tank 30*b*' of large capacity and the color ink tank 30*a*' of large capacity as shown in FIG. 6 are mounted within the ink tank holder 60, as well as a third service form in which the black ink tank 30*b* of normal capacity and the color ink tank 30*a*' of large capacity are mounted within the ink tank holder 60, and a fourth service form in which the black ink tank 30*b*' of large capacity and the color ink tank 30*a* of normal capacity are mounted within the ink tank holder 60. In this case, the first recording mode is selected in the first service form, or the second recording mode is selected in the second, third and fourth service forms to perform the desired image recording.

Also, the portable ink jet printer of this example is provided with a carriage protection cover open detection function as described below, due to the facts that (1) either the ink tank of small capacity or the ink tank of large capacity can be mounted on the recording head cartridge in accordance with the uses, wherein the carriage protection cover must be opened in use when the recording head cartridge with the ink tank of large capacity is mounted on the carriage, and (2) in the recording operation, particularly in a fine mode of recording, especially for outputting the high resolution image, by scanning the head (carriage) at least twice or more to discharge the ink into the recording area, the image quality may degrade due to ink mist, wherein the carriage protection cover should be desirably opened for use. It should be noted that in this example, when the locking mechanism (as above described, not shown) for locking the carriage protection cover in the open state operates to lock the carriage protection cover opened, it is detected that "the carriage protection cover is open". However, it is not necessarily limited thereto, and a microswitch provided at a position where the carriage protection cover is opened may be used to detect that the carriage protection cover is open.

Figure 9:
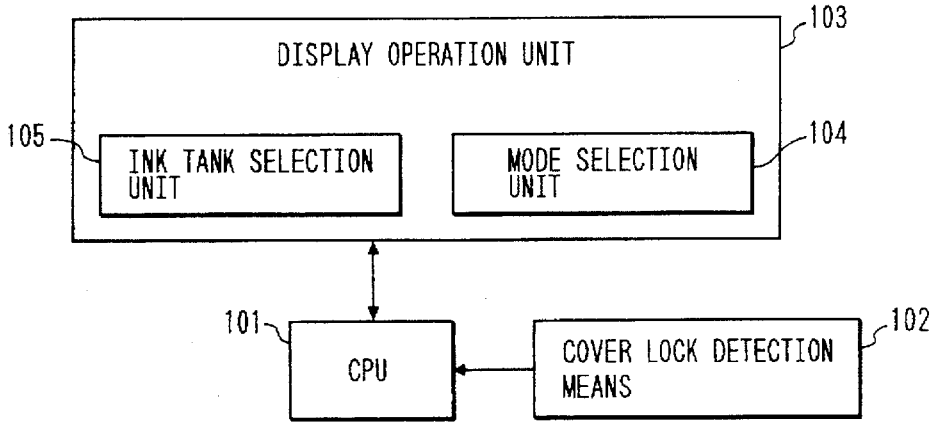
FIG. 9 is a block diagram showing the schematic configuration of a carriage protection cover lock detection function provided in the portable ink jet printer of this example.
Figure 10:
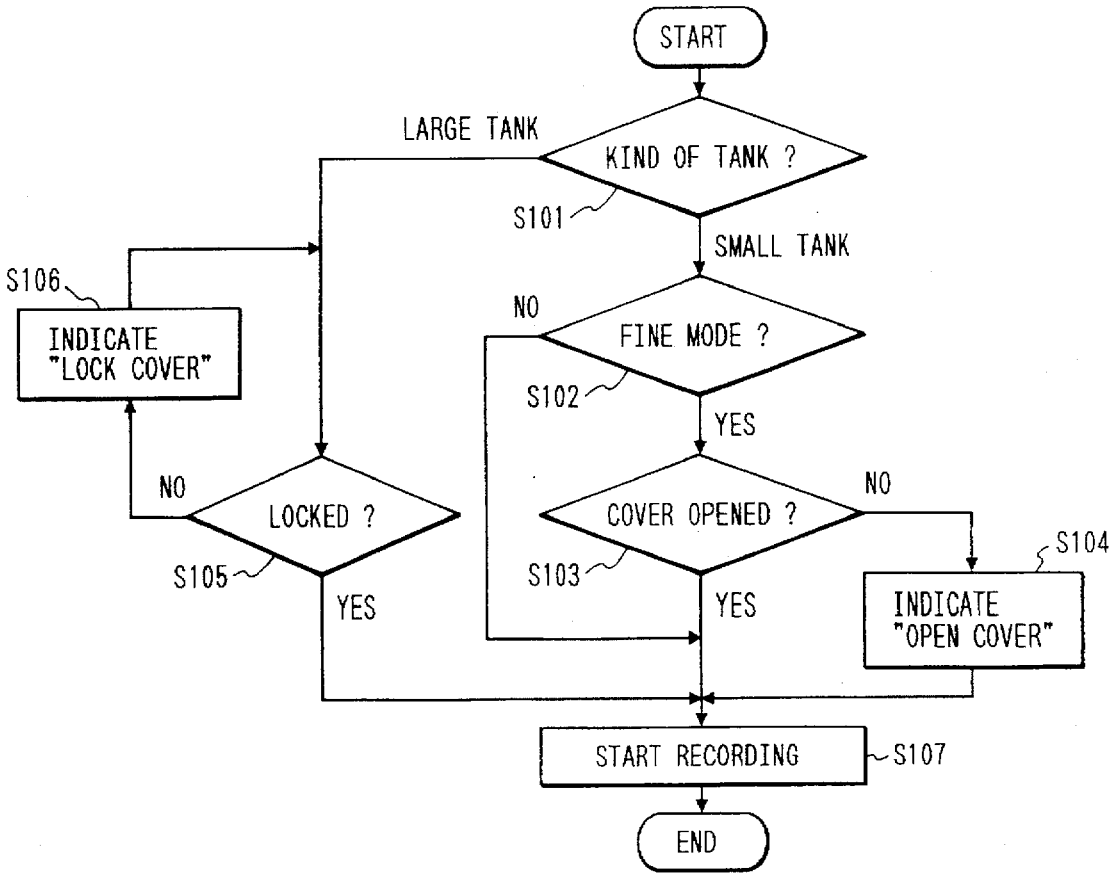
FIG. 10 is a flowchart for explaining a processing of carriage protection cover lock detection function as shown in FIG. 9.

FIG. 9 is a block diagram showing the schematic configuration of the carriage protection cover open detection function provided on the portable ink jet printer of this example, and FIG. 10 is a flowchart for explaining a processing of the carriage protection cover open detection function as shown in FIG. 9.

In FIG. 9, the carriage protection cover open detection function is comprised of a CPU 101, and a cover lock detection means 102 and a display operation unit 103 each of which is connected to the CPU 101.

The cover lock detection means 102 is to detect whether the carriage protection cover is locked in the open state, wherein the result of whether the cover is locked is output to the CPU 101.

The display operation unit 103 has an ink tank selection section 104 for inputting the kind of ink tank within the recording head cartridge which is mounted on the carriage, and a recording mode selection section for inputting a recording head (normal mode, fine mode) 105, herein an input instruction from those selection sections by the operator is output to the CPU 101. Also, this display operation unit 103 allows display of an instruction from the CPU 101.

In the above carriage protection cover lock control system, if the recording head cartridge is mounted on the carriage, the following processing is performed as shown in FIG. 10.

First, it is determined whether the size of the ink tank accommodated within the recording head which is mounted on the carriage is of the small capacity or large capacity, based on the input by the operator at the ink tank selection section 104 in the display operation unit 103 (S101).

If the ink tank is of the small capacity at step S101, it is subsequently determined whether or not the selected recording mode is a fine mode, based on the input by the operator at the recording mode selection section 105 in the display operation unit 103 (S102). If the recording mode is not the fine mode (herein, normal mode) at step S102, the recording is started directly, or if it is the fine mode, it is subsequently determined whether or not the cover is opened, based on the lock state of cover detected by the cover lock detection means 102 (S103). If the cover is opened at step S103, the recording is directly started, or if the cover is not opened, a message "open the cover" appears on the display operation unit 103, whereby the carriage protection cover is opened in accordance with that message, or the recording is started in a predetermined time after the display (S104, S107).

On the other hand, if the ink tank is of the large capacity at step S101, it is subsequently determined whether or not the cover is locked, based on the cover locked state detected by cover lock detection means 102 (S105). If the cover is locked at step S105, the recording is started (S107), or if it is not locked, a message "lock the cover" appears on the display operation unit 103, and step S105 is executed again (S106).

In the above description, the kind of ink tank is determined based on the input by the operator, but other ways can be conceived, and it may be electrically determined by providing an electrical resistance reading terminal which is discriminative on the carriage, and providing a different resistive element on the tank. Also, the opening or closing of the carriage protection cover is determined based on the detection result of cover lock detection means 102, but only for the purpose of the cover opening operation in the fine mode, a sensor for sensing that the cover is closed may be provided.

By instructing the opening or closing of the carriage protection cover with a carriage protection cover lock detection system, as above described, it is possible to prevent the carriage protection cover from falling to the carriage side during the recording, and damaging the carriage, because the carriage protection cover is not locked, when the recording head cartridge having the ink tank of large capacity is mounted on the carriage. Further, in the recording operation at the fine mode, the degradation of image quality due to ink mist can be mitigated.

As above described, according to this example, an ink jet printer which is excellent in the portability, and capable of effecting the high resolution image recording can be obtained.

Also, an ink jet printer and an ink tank attached to the printer can be obtained which the user can select simply in accordance with the use purpose of the user, and the service conditions (e.g., color output (for high resolution), monochrome output (for higher speed), output at the destination (with enhanced portability), and output on the desk (for lower running cost)).

Furthermore, if the image recording is effected by opening the carriage protection cover at every time when there occurs a quantity of ink mist in the fine mode for outputting the high resolution color image, it is possible to avoid a greater amount of ink mist adhering to the recording medium, which may arise due to the longer paper feed stop time caused by the increase in the number of head scans.

What is claimed is:

1. An ink jet printer for recording on a recording medium by discharging the ink supplied from an ink storing member from an ink jet head to the recording medium, comprising:

a mount portion for mounting detachably said ink storing member;

a space for receiving said mount portion; and a recording selection unit for selecting a first recording mode in which a first ink storing member received within said space is mounted on said mount portion in recording, or a second recording mode in which a second ink storing member large enough not to be received within said space is mounted on said mount portion in recording.

2. An ink jet printer according to claim 1, wherein said first ink storing member and said second ink storing member are substantially equivalent in the mount area when mounted on said mount member, said second ink storing member being higher than said first ink storing member.

3. An ink jet printer according to claim 1, wherein the ink storing capacity of said second ink storing member is at least one-and-half times or more that of said first ink storing member.

4. An ink jet printer according to claim 1, wherein said ink jet head uses the heat energy which electrothermal converters generate to discharge the ink.

5. An ink jet printer for recording on a recording medium by discharging the ink supplied from an ink storing member from an ink jet head to the recording medium, comprising:

a mount portion for mounting detachably said ink storing member;

a space for receiving said mount portion;

a cover member which is displaceable between a first position for covering said mount portion and a second position, apart from said first position, for opening said space to the outside; and a recording selection unit for selecting a first recording mode in which a first ink storing member received within said space is mounted on said mount portion in recording, or a second recording mode in which a second ink storing member received in said space with said cover member displaced to said second position and an outer space consecutive to said space is mounted on said mount portion in recording.

6. An ink jet printer according to claim 5, further comprising a determination portion for determining whether the ink storing member mounted on said mount portion is a second ink storing member, and a detection portion for detecting that said cover member has been displaced to said second position, wherein said second recording mode can be selected, based on a determination result of said determination portion and a detection result of said detection portion.

7. An ink jet printer according to claim 5, wherein said first ink storing member and said second ink storing member are substantially equivalent in the mount area when mounted on said mount member, said second ink storing member being higher than said first ink storing member.

8. An ink jet printer according to claim 5, wherein the ink storing capacity of said second ink storing member is at least one-and-half times or more that of said first ink storing member.

9. An ink jet printer according to claim 5, wherein said ink jet head uses the heat energy which electrothermal converters generate to discharge the ink.

10. An ink jet printer for recording on a recording medium by discharging the ink supplied from an ink storing member from an ink jet head to the recording medium, comprising:

a mount portion for mounting detachably a first ink jet head for discharging a first color ink, a second ink jet head for discharging a second color ink, a first ink storing member for storing said first color ink, and a second ink storing member for storing said second color ink; and a recording selection unit for selecting a first recording mode in which said first ink storing member and said second ink storing member which can be received within said space are mounted on said mount portion in recording, or a second recording mode in which said first ink storing member and said second ink storing member, at least one of which is large enough not to be received within said space, are mounted on said mount portion in recording.

11. An ink jet printer according to claim 10, wherein said ink storing member which can be received within said space and said ink storing member large enough not to be received within said space are substantially equivalent in the mount area when mounted on said mount member, said ink storing member large enough not to be received within said space being higher than said ink storing member which can be received within said space.

12. An ink jet printer according to claim 10, wherein the ink storing capacity of said ink storing member not received within said space is at least one-and-half times or more that of said ink storing member received within said space.

13. An ink jet printer according to claim 10, wherein said first color is black and said second color is yellow, cyan and magenta.

14. An ink jet printer according to claim 10, wherein said first ink jet head and said second ink jet head use the heat energy which electrothermal converters generate to discharge the ink.

15. An ink jet printer for recording on a recording medium by discharging the ink supplied from an ink storing member from an ink jet head to the recording medium, comprising:

a mount portion for mounting detachably a first ink jet head for discharging a first color ink, a second ink jet head for discharging a second color ink, a first ink storing member for storing said first color ink, and a second ink storing member for storing said second color ink;

a cover member which is displaceable between a first position covering said space and a second position, apart from said first position, for opening said space to the outside; and a recording selection unit for selecting a first recording mode in which said first ink storing member and said second ink storing member which can be received within said space are mounted on said mount portion in recording, or a second recording mode in which said first ink storing member and said second ink storing member, at least one of which has to be received within said space with said cover member displaced to said second position and an outer space consecutive to said space, are mounted on said mount portion in recording.

16. An ink jet printer according to claim 15, further comprising a determination portion for determining whether the ink storing member mounted on said mount portion is an ink storing member which has to be received within said space and an outer space continuous to said space, and a detection portion for detecting that said cover member has been displaced to said second position, wherein said second recording mode can be selected, based on a determination result of said determination portion and a detection result of said detection portion.

17. An ink jet printer according to claim 15, wherein the ink storing capacity of said ink storing member which has to be received within said space and said outer space consecutive to said space is at least one-and-half times or more that of said ink storing member which can be received within said space.

18. An ink jet printer according to claim 15, wherein said first color is black and said second color is yellow, cyan and magenta.

19. An ink jet printer according to claim 15, wherein said first ink jet head and said second ink jet head use the heat energy which electrothermal converters generate to discharge the ink.

20. An ink jet printer for recording on a recording medium by discharging the ink supplied from an ink storing member from an ink jet head to the recording medium, comprising:

a mount portion for mounting detachably said ink storing member, with an engaging portion for engaging said ink storing member; and a recording selection unit for selecting a first recording mode in which said ink storing member received within said space is mounted on said mount portion in recording, or a second recording mode in which said ink storing member large enough not to be received within said space is mounted on said mount portion in recording;

said ink storing member comprising:

a housing having a mount surface placed on said mount portion and a space for storing the ink; and an engaged portion for allowing said housing to be engaged with said mount member in cooperation with said engaging portion of said mount member.

* * * * *

UNITED STATES PATENT AND TRADEMARK OFFICE

CERTIFICATE OF CORRECTION

PATENT NO. : 5,742,310

DATED : April 21, 1998

INVENTOR(S) : YASUO KOTAKI

It is certified that error appears in the above-identified patent and that said Letters Patent is hereby corrected as shown below:

TITLE PAGE:

[56] REFERENCES CITED

Foreign Patent Documents
"0501789 2/1992" should read --0501789 9/1992--.
"0526062 3/1993" should read --0526062 2/1993--.
"4282253" should read --4-282253--.

COLUMN 1

Line 38, "portably." should read --portability.--.

COLUMN 10

Line 42, "one-and-half" should read --one and one-half--.

COLUMN 11

Line 8, "one-and-half" should read --one and one-half--.

UNITED STATES PATENT AND TRADEMARK OFFICE

CERTIFICATE OF CORRECTION

PATENT NO. : 5,742,310

DATED : April 21, 1998

INVENTOR(S) : YASUO KOTAKI

It is certified that error appears in the above-identified patent and that said Letters Patent is hereby corrected as shown below:

COLUMN 12

Line 11, "one-and-half" should read --one and one-half--.

Signed and Sealed this

Sixteenth Day of February, 1999

*Attest:*

*Attesting Officer*

*Acting Commissioner of Patents and Trademarks*